United States Patent [19]

Page

[11] Patent Number: 4,667,918

[45] Date of Patent: May 26, 1987

[54] ROTATABLE MAILBOX PEDESTAL

[76] Inventor: Robert Page, 5877 S. Fulton Way, Englewood, Colo. 80111

[21] Appl. No.: 751,197

[22] Filed: Jul. 2, 1985

[51] Int. Cl.[4] ..... B65D 91/00

[52] U.S. Cl. ..... 248/418; 248/553; 248/417; 248/131; 232/17; 232/39

[58] Field of Search ..... 248/553, 418, 406.1, 248/131, 145, 406.2, 425, 417; 232/39, 17, 28; 297/349; 70/185, 186

[56] References Cited

U.S. PATENT DOCUMENTS

| | | | |
|---|---|---|---|
| 718,190 | 1/1903 | Burnham | 232/28 |
| 877,006 | 1/1908 | Scobee . | |
| 894,577 | 7/1908 | Bessner . | |
| 1,350,770 | 8/1920 | Bates et al. . | |
| 1,534,920 | 4/1925 | Cox . | |
| 1,642,806 | 9/1927 | Choate . | |
| 1,902,282 | 3/1933 | Hultgren | 248/425 |
| 2,184,652 | 12/1939 | Sandberg | 70/185 |
| 2,674,301 | 4/1954 | Harting | 248/406.1 |
| 2,911,174 | 11/1959 | Goss . | |
| 3,407,997 | 10/1968 | Wood et al. . | |
| 3,827,626 | 8/1974 | Daigle . | |
| 3,833,168 | 9/1974 | Sackrison . | |
| 3,913,880 | 10/1975 | Lucasey | 248/553 |
| 3,994,148 | 11/1976 | Anderson | 248/553 |
| 4,014,507 | 3/1977 | Swenson | 248/425 |
| 4,231,539 | 11/1980 | Sandham | 248/418 |

*Primary Examiner*—Reinaldo P. Machado
*Assistant Examiner*—A. Chin-Shue
*Attorney, Agent, or Firm*—Sheridan, Ross & McIntosh

[57] ABSTRACT

A rotatable mailbox pedestal is disclosed having a locking mechanism configured such that after being unlocked to permit rotation, it can be relocked in a forward orientation automatically, i.e. without further manipulation of the lock. The locking mechanism comprises a bail member pivotally mounted to the rotatable portion of the pedestal and having a notch positioned such that when rotation of the pedestal brings the notch in alignment with the bolt of the lock, the bail member pivots downward under the force of gravity to engage the notch with the lock bolt. Means are provided for conveniently and securely mounting a lock of the type commonly used in postal applications so that a postal worker may unlock the pedestal for rotation, withdraw the key for use on a mailbox mounted on the pedestal, and relock the pedestal in a forward position without further use of the key.

9 Claims, 4 Drawing Figures

ROTATABLE MAILBOX PEDESTAL

FIELD OF THE INVENTION

This invention relates to a mailbox pedestal which provides for rotation of the mailbox and particularly to a locking mechanism for such a pedestal.

BACKGROUND OF THE INVENTION

A number of mailbox devices are adapted for mounting on an upright member such as a pole or post. In such a configuration, there are several situations in which it is advantageous to provide for varying the orientation of the mailbox by providing for rotation of the mailbox about a vertical axis. One such situation arises when the mailbox is configured such that the mail is deposited by the postal service through a rear door or opening, while the mail is retrieved by the postal patron through a front door or opening. Such configurations are particularly common when a multiplicity of mailboxes are joined in a single unit such as a Neighborhood Delivery and Collection Box Unit or NDCBU. In such a unit, postal workers can gain access simultaneously to a multitude of mailboxes through a rear panel, which is opened by operation of a lock. Typically, all such locks in a geographical area such as a city are operated by a single configuration of a key which is carried by all postal workers. In this way, postal workers can be assigned to a variety of routes within a city without the necessity for obtaining a different key for each route.

The postal patron obtains access to a particular assigned mailbox within an NDCBU by means of a key which opens the lock on the front panel of his mailbox and no other.

Providing for rotation of a mailbox system such as an NDCBU which has both front and rear access doors is advantageous when it is impractical or expensive to provide a working area such as a driving space for the postal worker and postal patron both at the rear and at the front of the mailbox unit. For example, when space is at a premium, it may be desirable to mount a mailbox unit in close proximity to a building, fence or other obstruction. In such a case, providing for rotation of the mailbox unit about a vertical axis allows access to both front and rear mailbox entries despite the presence of a nearby obstacle. The presence of a snowbank may similarly obstruct access to some portion of the mailbox such as when the mailbox is mounted near a route which is cleared by snow plow.

Even in the absence of physical obstacles to portions of the mailbox, it may be more cost effective to provide for rotation of the mailbox than to provide facilities for access to both the front and the rear of the mailbox. In particular, a postal service may require the installation of a surface such as a concrete pad for use by the postal workers when delivering mail through a rear entry mailbox. Thus, a non-rotatable two-entry mailbox would require provision of a surface both in front and in the rear of a mailbox. Providing for rotation of such a mailbox eliminates the need for one of these two surfaces.

When the mailbox is designed for access from a vehicle on a roadway, providing for rotation of the mailbox allows vehicle-based access by both the postal worker and the postal patron.

Various other advantages can arise from providing a rotatable mailbox, even when the mailbox has only a single door. For example, in some places the orientation of the mailbox serves to provide a signal that the mailbox contains mail for collection or mail that has been delivered.

When a rotatable mailbox is provided for one of the reasons above, or for other reasons, it is desirable to include a mechanism for locking the mailbox in one or more orientations. In particular, it is desirable to provide a mechanism for locking the mailbox in an orientation that provides access to the postal patron. In this manner, the postal worker, after depositing mail in the appropriate mailboxes, may orient the mailboxes so that the postal patrons may collect their mail, and may lock the mailbox in this orientation so as to prevent tampering with the mailbox or shifting of the orientation of the mailbox in response to wind or other forces.

In providing a rotatable mailbox which can be locked in a preferred orientation, a number of problems arise, owing partly to certain characteristics of locks which are commonly used in the postal delivery service. As noted above, it is common for postal locks in a given geographical area to be of a single configuration, allowing for common keying of such locks. Locks which are typically used in postal delivery are characterized by a mechanism in which inserting a key into the lock allows the postal worker to turn the key and thus withdraw a bolt allowing a mailbox door to be opened. After depositing or retrieving mail, the mailbox door is shut and the key is turned so as to once more extend the lock bolt. In conventional postal locking mechanisms, such extension of the bolt engages the postal lock. Conventional mechanisms, when applied to a rotatable mailbox, thus present two unattractive alternatives. The postal worker may carry two keys, one to unlock the rotation mechanism lock to allow access to the rear of the mailboxes, and a second key to open the rear of the mailbox. Alternatively, the mechanism may be lockable in its rear-access position, so that the postal worker must unlock the rotation mechanism, rotate the mailbox to the rear-access position, relock the rotation mechanism in this position, remove the key, use the key on the rear door of the mailbox, remove the key from the rear door lock, insert the key in the rotation lock, unlock the rotation mechanism, rotate the mail box to the front access position, and relock the rotation mechanism in the front access position. The first alternative requires doubling the supply of keys in circulation, presenting both a higher cost and an increased risk of postal keys falling into unauthorized hands. The two keys operate in locks which are physically spaced apart, and thus the keys typically can not be placed on a single keychain, thus increasing the risk of loss. The second alternative creates an undesirable proliferation of steps involved in delivery of mail, reducing efficiency and increasing costs of delivery.

Another characteristic of the type of locks commonly used in postal applications is that such locks have a tendency to bind if the nut and bolt mounting means is over-tightened. However, a lock for a rotatable mailbox must be quite securely mounted in order to avoid tampering and to prevent wear and/or slippage which might result from excessive play between the bolt of the lock and the locking mechanism.

Mechanisms have been proposed for latching a rotatable mailbox in a particular orientation which involve using a spring to bias a horizontally oriented bolt so that the bolt will move horizontally into a notch on a vertically stationary ring when the bolt aligns with the notch.

Mechanisms for securing a rotatable mailbox which depend upon springs for the required latching force have been found unsatisfactory because such mechanisms are susceptible to mechanical failure and/or corrosion, rusting or clogging caused by exposure to water, mud, or snow. These latching mechanisms must be either readily accessible for maintenance purposes, thus increasing both the risk of tampering and exposure to the elements, or must be covered or protected in some manner, thus increasing the costs of maintenance because of the need for removing such covering or protection before performing maintenance. Maintenance requirements are particularly acute when the mechanism is intended for use with an NDCBU, since such a unit is typically in use on a nearly daily basis and, further, is typically heavy, compared to a single mail box unit.

Further, it has been found that spring-dependent latching mechanisms lack the strength which is necessary for a practical rotatable mailbox pedestal. A rotatable mailbox pedestal should exhibit sufficient strength to maintain its structural integrity even when subjected to strong forces. Preferably a mailbox pedestal should be able to withstand a force by 500 lbs pull applied to its apex in any direction.

Accordingly, it is an objective of this invention to provide a pedestal for rotatably mounting a mailbox which can be unlocked for rotation to a rear orientation and which will relock automatically (i.e. without further use of a key) upon rotation to a forward orientation.

It is also an object of this invention to provide a pedestal for a rotatable mailbox which can be unlocked using the same key carried by postal workers for unlocking the mailboxes.

It is a further object of this invention to provide means for mounting a lock for a rotatable mailbox pedestal which provides security and strength along with ease of installation and operation.

It is another object of this invention to provide a locking means for a rotatable mailbox pedestal which is simple in operation, avoiding dependence on springs so as to reduce maintenance costs while maintaining security.

SUMMARY OF THE INVENTION

The present invention provides a rotatable mailbox pedestal having a locking mechanism which is particularly suitable for a mailbox pedestal application. The locking mechanism is usable with the type of lock used in the mailboxes themselves so that mail can be easily and efficiently delivered to the unit using only one key. The locking mechanism is configured such that the pedestal can be unlocked for rotation and will automatically relock when returned to a forward position, thus avoiding a second insertion of the key into the pedestal or the necessity for carrying more than one key. The mechanism operates by gravity, thus avoiding the mechanical failure and maintenance costs associated with spring-loaded latches. The resulting lowered maintenance requirement allows the latching mechanism to be placed inside the pedestal to avoid tampering and exposure to the elements.

According to the present invention, the locking mechanism includes a notched bail member which is pivotally mounted on a rotatable upper portion of the pedestal, preferably pivoting on a horizontal axis which intersects the pedestal rotation axis. Means are provided for mounting the type of lock commonly used in mail box applications. The lock is mounted in such a position that the bolt of the lock extends upwardly to engage with the notch in the bail. In operation, a key is employed to withdraw the bolt of the lock from engagement with the bail notch, freeing the upper portion of the pedestal for rotation. When the upper portion of the pedestal is rotated, it rotates the bail which is attached thereto, and moves the bail notch out of alignment with the lock bolt. The lock bolt may now be extended upward using the key, and the key may be withdrawn. Since the bail notch has been rotated out of alignment with the lock bolt, it does not engage therewith and the pedestal can still be freely rotated even though the lock bolt is extended. During such rotation, the lock bolt may be entirely disengaged from contact with the bail, or the lock bolt may contact the lower surface of the bail causing the bail to pivot upward. In this manner, it is possible to rotate the mailbox to a rearward position so that the postal worker may gain access to the rear of the mailboxes, employing the key which had been used to unlock the pedestal. Following delivery of the mail, the pedestal may be automatically relocked by rotating it to its former forward position. As the pedestal is rotated to the forward position, the lock bolt contacts the underside of the bail, pivoting it upwards. Rotation is continued until the pedestal is placed in an orientation in which the notch in the bail is aligned with the lock bolt. In this orientation, gravity will cause the bail to pivot downwards so that the lock bolt engages with the notch, preventing further rotation.

The locking mechanism of the present invention requires that a bolt-type lock be mounted in such a position that the lock bolt will engage with the bail notch when the upper portion of the pedestal is rotated to a desired position. According to the present invention, an apparatus is provided for mounting a lock in such a position. This apparatus includes a horizontal plate inside a base shaft portion and an angled plate having an L-shaped profile. One leg of the angled plate is provided with lock mounting means in such a position that a lock may be flush-mounted to this leg of the angled plate. When the lock has been thus mounted, the other leg of the angled plate may be attached to the horizontal plate using a number of alignable holes in the plates. When the angled plate has been attached to the horizontal plate, the lock will be sturdily and securely mounted in a position which will provide for the desired engagement of the lock bolt with the notch of the bail.

DETAILED DESCRIPTION OF THE PREFERRED EMBODIMENT

According to the present invention, a rotatable pedestal for mounting a mailbox is provided comprising a nonrotating base portion, an upper rotatable pedestal portion, and a lock mechanism. The nonrotating base preferably comprises a base plate for connection to a footing and a base shaft attached to the base plate and extending vertically upward therefrom. The upper rotatable pedestal portion preferably comprises a pedestal shaft continuing vertically upward from the base shaft and rotatably mounted to the base shaft by means of a bearing; and a pedestal plate at the upper end thereof, configured for attachment of a mailbox unit to the pedestal plate. The lock mechanism comprises a notched bail pivotally mounted on the upper rotatable pedestal portion, and a lock mounting apparatus. The lock mounting apparatus preferably comprises a flat plate attached to the base shaft and an angled plate attached to the base shaft plate.

Figure 1:
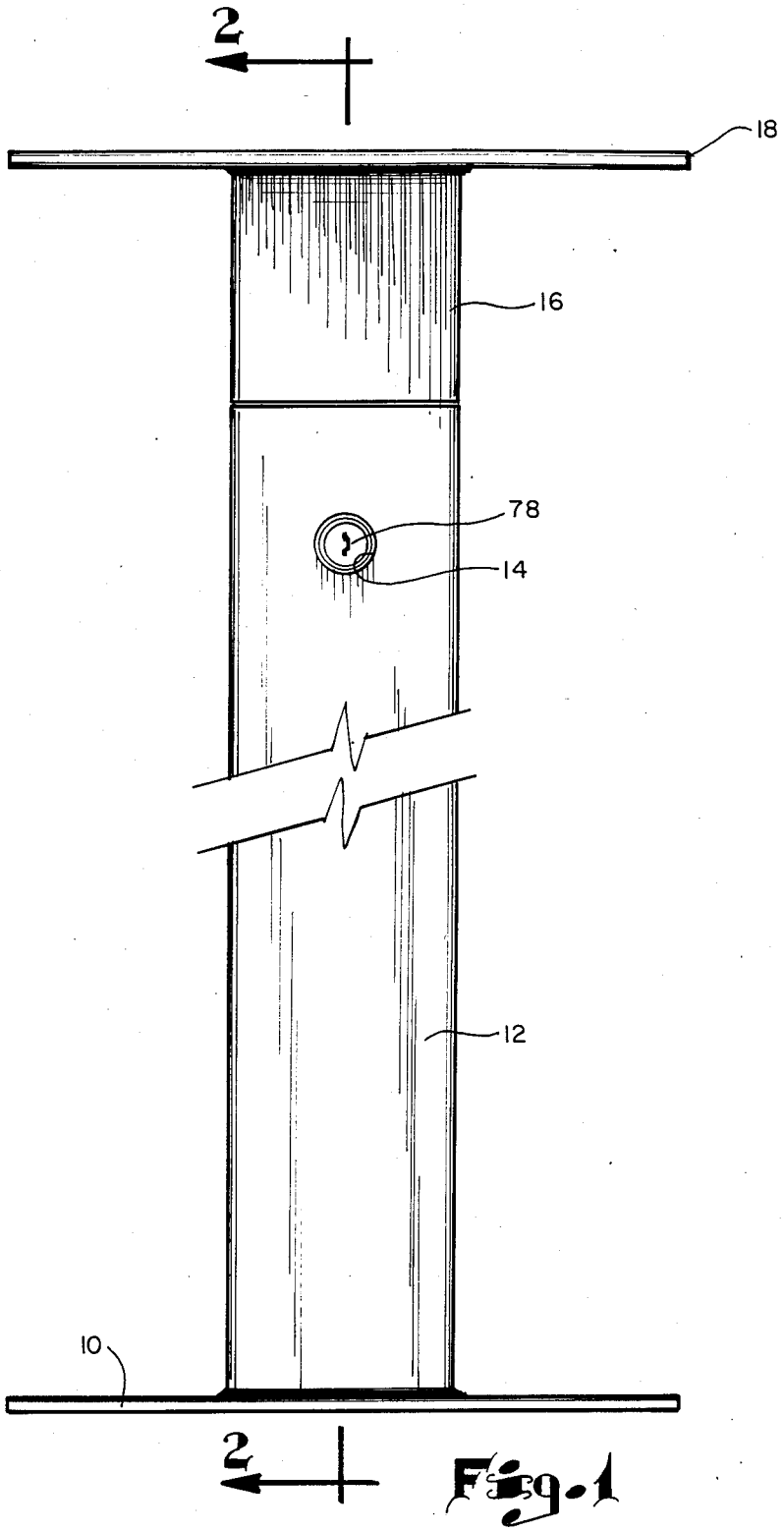
FIG. 1 is an elevational view of the rotatable mailbox pedestal in a locked configuration.

Referring now to FIG. 1, in the preferred embodiment of the present invention, the pedestal comprises a base plate 10 configured for attachment to a footing which is sunk in the ground in a desired position. The base plate 10 may be provided with a number of holes 11 for mounting the base plate 10 to a footing, as by bolts embedded in the footing. The plate 10 may be made of a number of materials, but is preferably fashioned from a steel plate. A base shaft 12 is attached to the base plate 10, preferably by welding. The base shaft 12 may be of a number of configurations, but is preferably a hollow steel tube with a substantially square cross section. The base shaft 12 is of a height sufficient to provide for convenient access when a mailbox is mounted to the top of the pedestal, and in the preferred embodiment is about 22 inches in height. A hole 14 is provided in the wall of the base shaft 12 of such dimension and position as to provide convenient access to the keyway of a lock which is mounted on the base shaft 12 in a manner described below.

The rotatable portion of the pedestal, comprises a pedestal shaft 16 and a pedestal plate 18 attached to said pedestal shaft preferably by welding. The pedestal shaft 16 is preferably formed of steel tubing preferably about 4 inches in length with a square cross section, substantially similar to the cross section of the base shaft 12. The base shaft 12 thus defines a cavity 13 having a cross section in the shape of a square. Similarly the pedestal shaft 16 defines a cavity 47 having a cross section in the shape of a square. The pedestal plate 18 is fashioned from a steel plate and contains devices for mounting a number of different styles of mailboxes. These mounting devices are preferably a plurality of holes 20 formed in the pedestal plate 18 and configured to accommodate the mounting means supplied with a number of commercially available mailboxes and/or NDCBU's.

Figure 2:
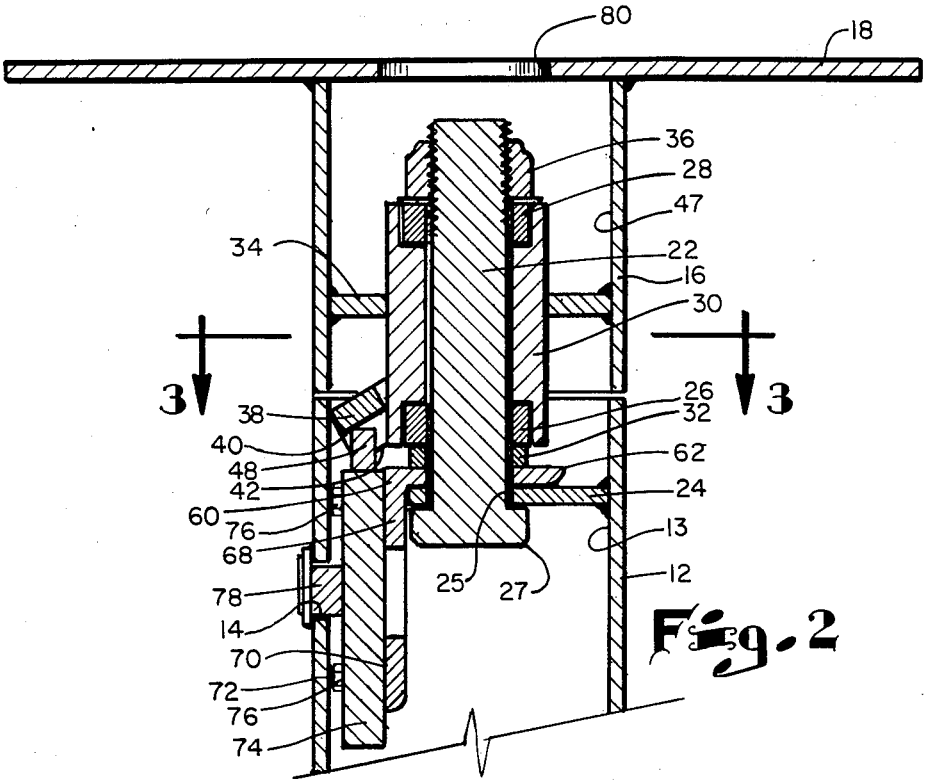
FIG. 2 is a longitudinal cross sectional view taken along line 2—2 of FIG. 1.

The pedestal shaft 16 is rotatably mounted on the base shaft 12 by a bearing-axle mechanism, as best seen in FIG. 2. The axle of this mechanism is preferably a bolt 22 attached to a base shaft plate 24 by welding the bolt head 27 to the base shaft plate 24. The base shaft plate 24 is mounted inside the base shaft 12. The axle bolt 22 must have sufficient strength to support the rotatable portion of the pedestal and a fully-loaded mailbox attached thereto. The axle bolt 22 is preferably a $\frac{3}{4}$ inch by 5 inch bolt, threaded at one end. The pedestal of the present invention has been found sufficiently sturdy to withstand a pulling force of 500 lbs applied to its apex, perpendicular to its vertical axis. The axle bolt 22 extends through a hole 25 in the base shaft plate 24. The hole 25 in the base shaft plate 24 is positioned such that the axle bolt 22 will lie along the preferred axis of rotation, normally being a longitudinal axis of symmetry of both the base shaft 12 and the pedestal shaft 16. The longitudinal axis of the axle bolt 22 defines the axis of rotation of the rotatable portion of the pedestal. The axle bolt 22 is preferably attached to the base shaft plate 24 by welding.

The base shaft plate 24 is a flat plate preferably fashioned of steel. It is rectangular in shape, with its longest side being substantially the same length as a side of the cross section of the base shaft cavity 13. The base shaft plate 24 is mounted in the cavity 13 by welding its two short sides and one of its long sides, to the interior surface of the base shaft 12. The long side of the base shaft plate 24 is welded to a surface opposite the surface containing the hole 14.

A lower bearing 26 and an upper bearing 28 surround the shaft bolt 22 and are spaced from each other by a sleeve 30. The lower bearing 26 and upper bearing 28 may be attached to the sleeve 30 by pressing the bearings 26 and 28 into the sleeve 30. The bearings may be any conventional rotation bearings. The sleeve 30 and the bearings 26 and 28 attached thereto are connected to the pedestal shaft 16 by means of a substantially square pedestal shaft plate 34 welded to the interior surfaces of the pedestal shaft 16 and having a hole 29 of such size as to accommodate the sleeve 30. Sleeve 30 is connected to the pedestal shaft plate 34 by welding. The lower bearing 26 is vertically spaced from the base shaft plate 24 by a cylindrical spacer 32. The spacer 32 is of such length as to maintain the pedestal shaft 16 in proper spaced relation from the base shaft 12 such that the base shaft 12 does not touch the pedestal 16 during rotation. The sleeve and bearing assembly is held firmly against the spacer 32 by means of a nut 36 mounted on the threaded portion of the axle bolt 22.

Figure 3:
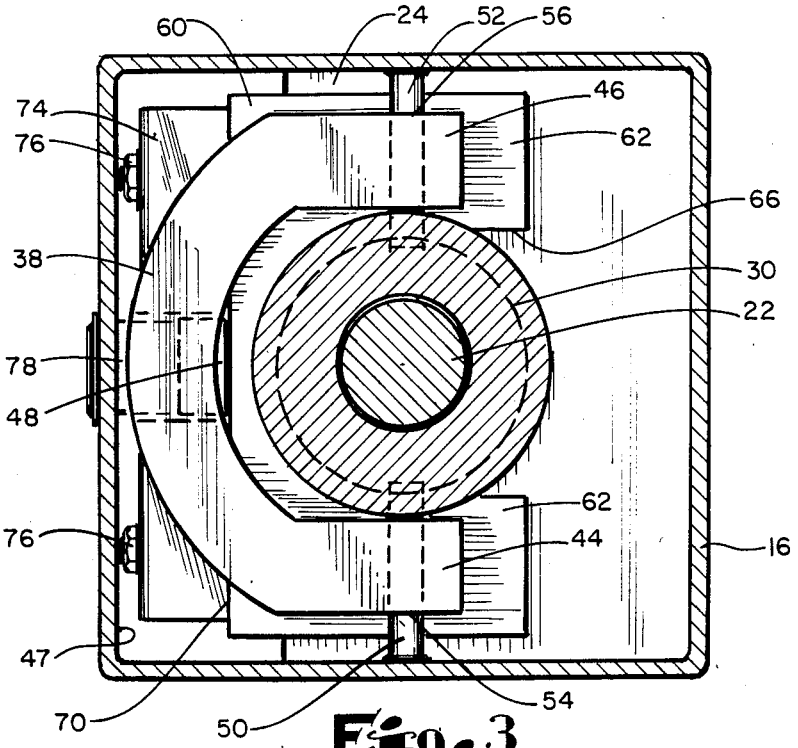
FIG. 3 is a lateral cross sectional view taken along line 3—3 of FIG. 2.

The rotation locking mechanism of the present invention comprises a bail 38 and an apparatus for mounting a lock with an extendable bolt. The bail 38 is a horseshoe-shaped plate, best seen in FIG. 3, having a notch 40 formed into its lower surface 42, preferably at the apex of the bail 38. The bail 38 is of such size that the space between the legs 44 and 46 of the bail will accommodate the sleeve 30. The bail 38 is sufficiently small to lie within the base shaft cavity 13 or the pedestal shaft cavity 47, with sufficient clearance from the surfaces of the cavities 13 and 47 to allow for pivoting of the bail 38 as described below. The bottom surface 42 (shown in FIG. 2) of the bail is substantially smooth to allow for sliding movement of the bail 38 with respect to the lock bolt 48 as described below. The notch 40 of the bail 38 is substantially of the same width as the lock bolt 48 and of a depth sufficient to provide for effective engagement of the lock bolt 48 in the notch 40.

The bail 38 is mounted so as to pivot along an axis passing through the bail legs 44 and 46. The pivoting axis is preferably perpendicular to the pedestal rotation axis and preferably intersects the pedestal rotation axis. The pivotal mounting of the bail 38 may be accomplished by mounting the bail 38 on the sleeve 30, on the pedestal shaft 16, or, preferably, by mounting to both the sleeve 30 and the pedestal shaft 16. The pivotal mounting is accomplished by providing pins 50 and 52 which extend through holes 54 and 56 in the bail arms 44 and 46 respectively. Pins 50 and 52 extend perpendicularly from the walls of the pedestal shaft 12 through the bail arm holes 54 and 56 and attach to the sleeve 30.

The bail 38 may be fashioned from a number of materials, but is preferably made of steel so as to provide for sufficient locking strength and sufficient weight for the gravity operation of the locking mechanism as described below.

Figure 4:
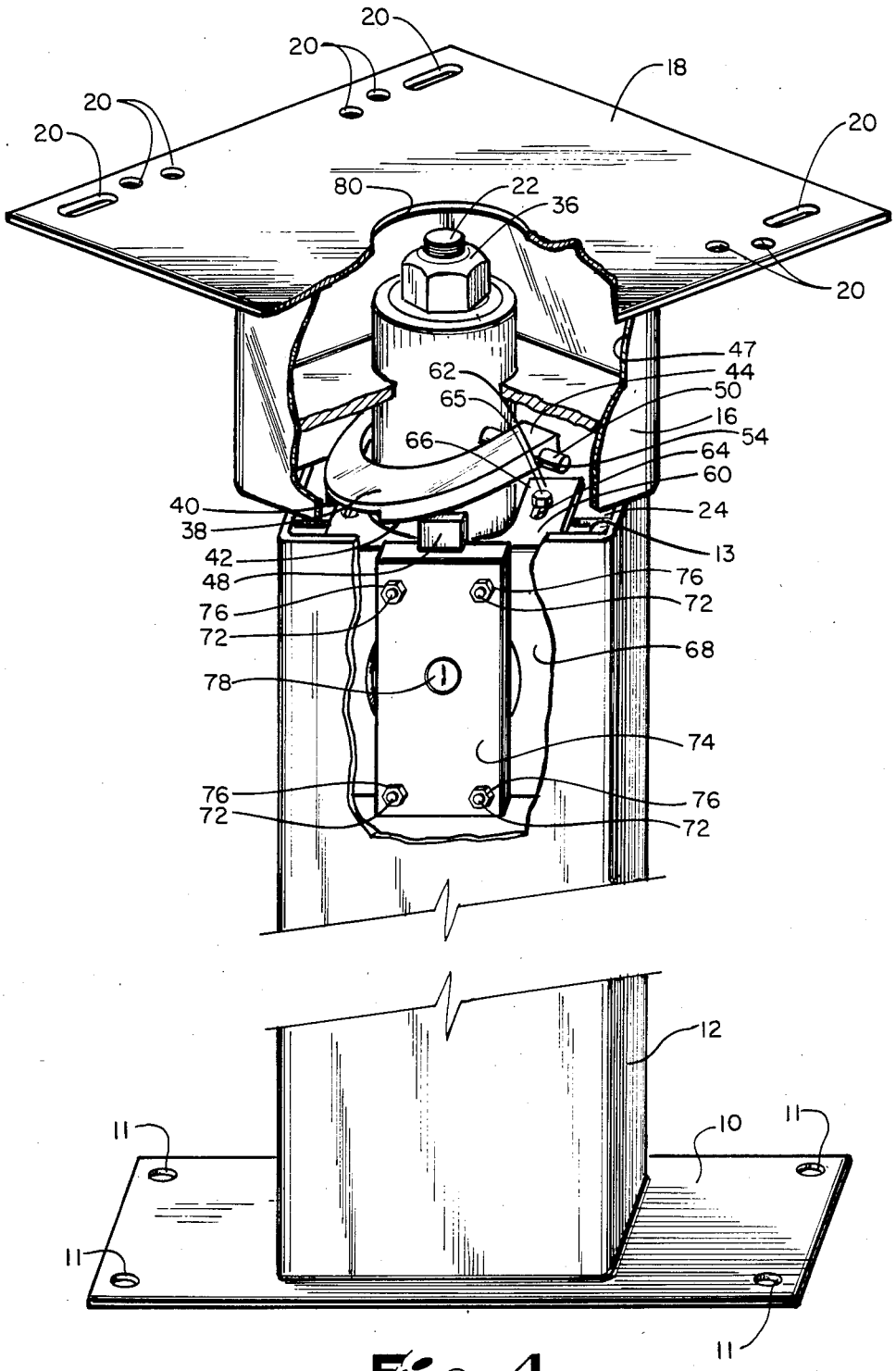
FIG. 4 is a perspective view of the pedestal in an unlocked, rotated position with portions of the pedestal cut away to show the locking mechanism.

The lock mounting mechanism of the present invention, best seen in FIG. 2, comprises an angled plate 60 having a substantially L-shaped profile. One leg 62 of the angled plate 60 is provided with holes 64 for attaching the angled plate 60 to the base shaft plate 24 in a horizontal position, using plate-mounting bolts 65. The holes 64 are preferably of an elongated shape so as to provide for adjustment of the position of the angled plate 60 with respect to the base shaft plate 24. The horizontal leg 62 is provided with a cutout 66 of such size as to accommodate the spacer 32. The other leg 68 of the angled plate 60 is substantially vertically oriented. Attached to the forward face 70 of the vertical leg 68 are lock-mounting bolts 72 as shown in FIG. 4. The bolts 72 are preferably flat-head bolts which are attached by welding the bolt head flush against the plate surface 70.

A lock 74, preferably of the type typically used in postal applications, is mounted flush against the surface 70 of the angled plate 60 by inserting the lock-mounting bolts 72 through holes provided in the lock 74 and attaching nuts 76 to the lock-mounting bolts 72. The angled plate 60 is of such configuration that when the lock 74 is attached to the angled plate 60 and the angled plate 60 is mounted on the base shaft plate 24, the keyway 78 of the lock 74 will protrude through the base shaft hole 14 and the lock bolt 48 will be oriented vertically and will lie in position such that it is aligned with the bail notch 40 when the pedestal shaft 16 is rotated to a forward position, i.e. a position that allows access of a postal patron to an assigned mailbox.

The lock 74 is mounted so as to provide proper vertical positioning of the lock bolt 48 with respect to the bail 38. Specifically, the lock must be mounted sufficiently high that the lock bolt 48 when vertically extended will extend into the notch 40 when the notch 40 is aligned with the lock bolt 48. The lock 74 must be mounted sufficiently low that when the lock bolt 48 is withdrawn to its lowest position, there will be no extension of the lock bolt 48 into the notch 40. The lock 74 must also be mounted sufficiently low that, during rotation, that the lock bolt 48 does not contact an unnotched portion of the bail 38 in such a manner as to interfere with rotation.

The manner of installation of the mailbox pedestal will now be described. A footing such as a poured concrete footing is constructed, preferably having bolts embedded therein. The pedestal is attached to the footing by inserting the footing bolts through the holes 11 of the base plate 10. The axle bolt nut 36 is unscrewed and removed through a central opening 80 of the pedestal plate 18. The pedestal plate 18 and attached pedestal shaft 16 are lifted off of the base shaft 12 and set aside. Plate mounting bolts 65 are removed and the angled plate 60 is withdrawn from the base shaft cavity 13. A lock 74 is attached to the angled plate 60 using lock-mounting bolts 72 and nuts 76 as described above. The angled plate 60 is then reinserted in the base shaft cavity 13 and positioned such that the keyway 78 of the lock 74 will protrude through the base shaft hole 14. The angled plate 60 is then attached to the base shaft plate 24 using the plate-mounting bolts 65. In this manner, the lock 74 may be firmly and securely mounted without overtightening the lock-mounting bolts 72. The lock is mounted in a position predetermined by the location of the angled plate bolt holes 64 to provide proper alignment of the lock bolt 48.

The pedestal shaft 16 is placed over the base shaft 12 by inserting the axle bolt 22 through the bearings 26 and 28. The nut 36 is reattached to the axle bolt 22. The pedestal is now properly installed and ready for attachment of a mailbox unit to the pedestal plate 18 in the manner described above.

The manner of operation of the mailbox pedestal will now be described. The rotatable portion of the pedestal will normally be oriented in its forward position, i.e. the position in which a postal patron can obtain access to an assigned mailbox. When the pedestal is oriented in this position, it will be locked against rotation about the pedestal rotation axis by engagement of the lock bolt 48 with the notch 40 of the bail 38, as best seen in FIG. 2. When the lock bolt 48 is engaged with the notch 40, it lies within the notch 40. A torque applied to the rotatable section of the pedestal which would tend to rotate it about the pedestal axis of rotation will cause torque to be transferred to the bail 38, since it is directly or indirectly attached to the pedestal shaft 16. Such an application of torque to the bail 38 will bring one of the side walls of the notch 40 to bear against the lock bolt 48, thus preventing any substantial rotation of the upper portion of the pedestal.

In order to achieve rotation of the upper portion of the pedestal, for example to obtain access to the rear portion of a mailbox unit attached to the pedestal, the lock 74 must be operated. A key is inserted into the keyway 78 of the lock 74 and turned so as to cause downward movement of the lock bolt 48, withdrawing the lock bolt 48 at least partially into the lock 74. With the lock bolt 48 withdrawn, there is no longer an engagement of the lock bolt 48 with the notch 40, so that a torque applied to the upper portion of the pedestal will result in rotation about the axis of rotation of the pedestal. The rotatable portion of the pedestal is rotated sufficiently to bring the notch 40 out of alignment with the lock bolt 48. Typically, the upper portion of the pedestal will be rotated 180° in order to provide access to the rear portion of a mailbox unit mounted on the pedestal. After the notch is brought out of alignment with the lock bolt 48, the key may be turned in the key way 78 so as to extend the lock bolt 48 upward. The key may now be withdrawn and used to obtain access to the rear door of a mailbox unit mounted on the pedestal.

When it is desired to reorient the pedestal in the forward position, a torque is applied to the upper portion of the pedestal, causing rotation of the pedestal shaft 16 and the bail 38. As the bail 38 rotates, the rotation will bring the lower surface 42 of the bail 38 into contact with the extended lock bolt 48. Continued rotation will cause the bail 38 to ride on the lock bolt 48, in turn causing the bail 38 to pivot upwards about the pivot pins 50 and 52. With continued rotation, the bail 38 will continue to ride on the lock bolt 48 until the notch 40 comes in alignment with the lock bolt 48. At this point, the lock bolt 48 will no longer be in contact with the bottom surface 42 of the bail 38, and the bail 38, under the force of gravity will pivot downwards about the pivot pins 50 and 52. As a result of such pivoting movement the notch 40 moves towards the stationary lock bolt 48 and comes to rest in a position such that the lock bolt 48 lies within the notch 40. In this configuration, the pedestal is locked against further rotation by engagement of the lock bolt 48 with the notch 40, as described above.

Although the foregoing invention has been described in some detail by way of illustration and example for purposes of clarity and understanding, it will be obvious that certain changes and modifications may be practiced within the scope of the invention, as limited only by the scope of the appended claims.

What is claimed is:

1. A mailbox pedestal comprising:

a base;

a pedestal shaft;

means for mounting said pedestal shaft on said base such that said pedestal shaft is rotatable about a vertical axis;

a bail member having a notch;

pivoting means for attaching said bail member to said pedestal shaft wherein said bail member rotates with said pedestal shaft about said vertical axis and said bail member pivots with respect to said pedestal shaft about a non-vertical axis; and means on said base for mounting a lock comprising an upwardly extendable bolt such that when said bolt is extended upward and said pedestal shaft is rotated about said vertical axis to a first position in which said notch is aligned with said bolt, a portion of said bail member pivots under the force of gravity so that said notch is engageable with said bolt to substantially prevent rotation of said pedestal shaft around said vertical axis and in which, when said bolt is extended to contact a first portion of said bail member and said pedestal shaft is rotated about said vertical axis to at least a second position in which said notch is out of alignment with said bolt, said bolt contacts a second portion of said bail member and in which said bail member is pivoted about said non-vertical axis during the time said pedestal shaft is rotated to said second position.

2. The pedestal of claim 1 further comprising:

a lock comprising an upwardly extendable bolt engaged with said notch; and means for withdrawing said bolt from engagement with said notch thereby allowing rotation of said pedestal shaft about said vertical axis.

3. The pedestal of claim 1 wherein said means for mounting said pedestal shaft comprises a bearing and axle apparatus.

4. The pedestal of claim 1 wherein said means for mounting a lock comprises:

a first plate attached to said base;

a second plate removably attached to said first plate and having a substantially vertical surface;

means for mounting a lock to said second plate substantially flush with said vertical surface.

5. The pedestal of claim 1 further comprising a plate attached to said pedestal shaft having means for attachment of a mailbox.

6. The pedestal of claim 1 wherein said bail member is mounted so as to pivot on a pivoting axis intersecting said vertical axis.

7. The pedestal of claim 6 wherein said pivoting axis lies in a horizontal plane.

8. A method for unlocking and locking a rotatable mailbox pedestal comprising:

providing a pedestal comprising a base, a lock comprising an upwardly extendable bolt, means on said base for mounting said lock, a pedestal shaft mounted on said base such that said pedestal shaft is rotatable about a vertical axis, and a bail member having a notch and pivoting means for attaching said bail member to said pedestal shaft wherein said bail member rotates with said pedestal shaft about said vertical axis and said bail member pivots with respect to said pedestal shaft about a non-vertical axis and wherein when said bolt is extended upward and said pedestal shaft is rotated about said vertical axis to a first position in which said notch is aligned with said bolt, a portion of said bail member pivots under the force of gravity so that said notch is engageable with said bolt to substantially prevent rotation of said pedestal shaft around said vertical axis and wherein when said bolt is extended to contact a first portion of said bail member and said pedestal shaft is rotated about said vertical axis to at least a second position in which said notch is out of alignment with said bolt, said bolt contacts a second portion of said bail member and wherein said bail member is pivoted about said non-vertical axis during the time said pedestal shaft is rotated to said second position;

using said lock to withdraw said bolt from engagement with said notch;

applying a torque to said pedestal shaft to rotate said pedestal shaft about said vertical axis;

using said lock to upwardly extend said bolt;

applying a torque to said pedestal shaft to bring said notch in alignment with said bolt, whereby said bail member pivots downward to engage said notch with said bolt.

9. A lockable rotatable mailbox pedestal comprising:

a base;

means for mounting a key-operable bolt lock on said base;

a pedestal shaft;

means for mounting said pedestal shaft on said base such that said pedestal shaft is rotatable about a vertical axis;

latching means comprising a notched member; and pivoting means for attaching said latching means to said pedestal shaft wherein when said pedestal shaft is rotated to align said notch with said bolt, a portion of said latching means pivots downward substantially as a result of the force of gravity to engage said notch with said bolt.

* * * * *